United States Patent [19]

Strik

[11] 4,095,134

[45] June 13, 1978

[54] ELECTROPHOTOGRAPHIC PREPARATION OF COLOR TELEVISION DISPLAY TUBE INCLUDING RINSING PHOSPHOR PATTERN WITH SOLUTION OF ANTISTATIC AGENT IN APOLAR SOLVENT

[75] Inventor: Francis Bernardus Strik, Eindhoven, Netherlands

[73] Assignee: U.S. Philips Corporation, New York, N.Y.

[21] Appl. No.: 646,975

[22] Filed: Jan. 6, 1976

[30] Foreign Application Priority Data

Jan. 10, 1975 Netherlands ..... 7500288

[51] Int. Cl.[2] ..... G03G 13/10; G03G 13/01; H01J 31/08; H01J 31/20

[52] U.S. Cl. ..... 313/470; 96/1 R; 96/1 LY; 96/1.2; 96/36.1; 427/16; 427/68

[58] Field of Search ..... 427/16; 96/1 R, 1.2, 96/1.3, 36.1, 1 LY; 313/470

[56] References Cited

U.S. PATENT DOCUMENTS

| | | | |
|---|---|---|---|
| 2,527,262 | 10/1950 | Hart et al. | 96/87 A |
| 3,475,169 | 10/1969 | Lange | 96/1.2 |
| 3,489,556 | 1/1970 | Drozd | 96/1 R |
| 3,489,557 | 1/1970 | Lange et al. | 96/1 R |
| 3,512,965 | 5/1970 | Matkan | 96/1 R |
| 3,764,312 | 10/1973 | Honjo | 96/1.3 |
| 3,793,018 | 2/1974 | Van Engeland et al. | 96/1 R |
| 3,806,340 | 4/1974 | Sato et al. | 96/1.3 |
| 3,856,518 | 12/1974 | Strik et al. | 96/1 R |

OTHER PUBLICATIONS

*Chemical Abstracts*, vol. 71, 1969, 82482m.

*Primary Examiner*—John T. Goolkasian
*Attorney, Agent, or Firm*—Frank R. Trifari; Norman N. Spain

[57] ABSTRACT

The electrophotographic manufacture of the phosphor patterns for a display screen of a color television display tube. This process is performed in as many stages as there are different phosphor zones and possibly also for a light-absorbing intermediate pattern. Contamination of a phosphor which has already been precipitated may easily occur with a next phosphor in this case. According to the invention this is obviated by an intermediate rinsing operation with a solution of an antistatic agent, in an apolar solvent. The antistatic agent is selected from the group consisting of soaps of bivalent metals, soaps of multivalent metals and mixtures thereof.

4 Claims, 1 Drawing Figure

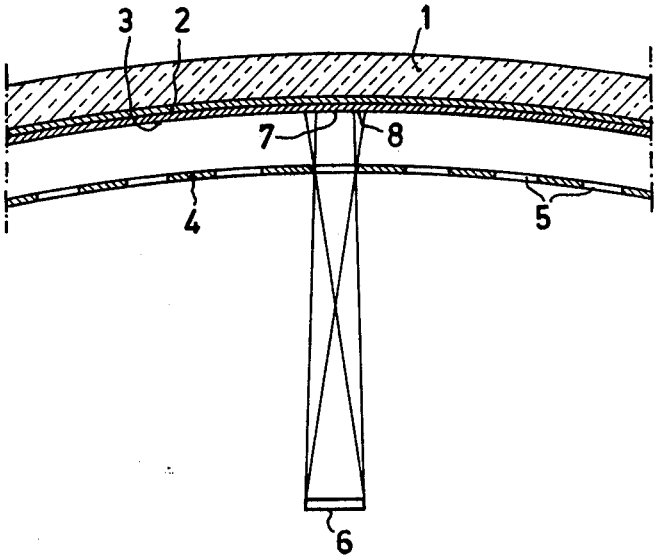
3
2
1
7
8
4
5
6

ELECTROPHOTOGRAPHIC PREPARATION OF COLOR TELEVISION DISPLAY TUBE INCLUDING RINSING PHOSPHOR PATTERN WITH SOLUTION OF ANTISTATIC AGENT IN APOLAR SOLVENT

The invention relates to a method of electrophotographically manufacturing a display screen for a colour television display tube and to a colour television display tube provided with a display screen thus obtained.

Such a method is known from U.S. Pat. No. 3,475,169. This method comprises: the provision of a combustible conducting coating on the face-plate of the tube, the provision of a combustible photo-conductive coating, the provision of a first pattern of phosphor zones by uniformly electrically charging the photo-conducting coating, the formation of a latent image comprising a charge in the areas corresponding to the said first pattern and the precipitation of charged phosphor particles in an apolar dispersion agent according to said first pattern, the provision in an analogous manner of at least one subsequent pattern of phosphor zones and possibly the provision of a light-absorbing coating between the phosphor zones by uniformly electrical charging of the photo-conducting coating with the phosphor zones and the precipitation between the charged phosphor zones of electrically charged light-absorbing particles from a developer liquid in which these particles are dispersed in an apolar liquid and finally heating of the face-plate in order to remove the conducting coating and the photo-conducting coating.

Said patent specification describes some modifications of this electrophotographic method. In a first modification the charged particles are precipitated on the charged zones of the latent image. Charged particles then of course have a polarity which is opposite to that of the latent image. In a second modification the charged particles are precipitated between the charged zones of the latent image while the charged particles have the same polarity as the latent image. In addition two methods of exposure are possible. According to the first method a positive light image of the apertures in a colour selection electrode is formed, and according to the second method a negative light image, i.e. each aperture in the colour selection electrode is represented by a shaded zone on the photo-conducting coating.

The dispersions of charged phosphor particles and of charged light-absorbing particles in an electrically insulating liquid are for example, those described in the U.K. patent specification No. 1,318,396 (U.S. Pat. No. 3,766,125). These dispersions consist of an apolar dispersion agent with an electrical conductivity of less than $10^{-14}Ohm^{-1}cm^{-1}$(1 p S/m), in which one or more surface-active, ion-forming materials are dissolved with bivalent or multivalent ions which have such a dissociation capacity that their electrical conductance in a $10^{-3}$ molar solution is larger than $10^{-12}Ohm^{-1}cm^{-1}$ (more than 100 p S/m) preferably between $1\times10^{-10}$ and $1\times10^{-11}Ohm^{-1}cm^{-1}$ (between 10,000 and 1000 p S/m) in which the said phosphor particles are dispersed. In practice suspensions having a conductivity in $10^{-3}$ mol solution of between 100 and 1000 p S/m were found to be preferred. The ion-forming materials build up a zeta potential on the barrier interface between the phosphor particles and the dispersion agent. In practice the Siemens/meter has been used of late years as a unit for electrical conductivity. The Siemens is equal to 1 $Ohm^{-1}$ so that 1 p S/m is equal to $10^{-14}Ohm^{-1}cm^{-1}$.

In the exposure method described hereinbefore in which the photo-conductor is negatively charged, the intermediate regions are exposed and no light is incident on the phosphor zones (the so-called dark field exposure), and after exposure development is effected with a dispersion having a positive zeta potential, while the photo-conductor must be negatively recharged before the next phosphor pattern is provided. The previously provided phosphor pattern is then also negatively charged. In the exposure for the next phosphor pattern the charge is insufficiently depleted from the previous phosphor pattern. During development the phosphor will also be deposited on the areas of the previously provided phosphor pattern. This gives rise to an altogether inadmissible colour contamination.

An object of the invention is to eliminate this colour contamination.

The method of electrophotographically manufacturing a display screen for a colour television display tube in the latter modification in which the photoconductor is exposed on the intermediate areas and developed with a dispersion of phosphor particles whose charge is opposite to that with which the photo-conductor is charged is characterized according to the invention in that after the provision of each phosphor pattern and before the next charge pattern is provided the screen is wetted with a solution of an antistatic agent in an apolar solvent the electrical conductivity of which solvent is less than $10^{-14}Ohm^{-1}cm^{-1}$ (1 p S/m) and is subsequently dried.

An antistatic agent, which can advantageously be used for this object is a metal soap of a bivalent or multivalent metal or a mixture of such metal soaps whose conductivity in the previously mentioned solvent is between $5\times10^{-12}$ and $10^{-10}Ohm^{-1}cm^{-1}$ (500 and 10,000 p S/m) and preferably between $10\times10^{-12}$ and $80\times10^{-12}Ohm^{-1}cm^{-1}$ (1000 - 8000 p S/m).

In one embodiment the intermediate rinsing operations are carried out with the aid of a $17\times10^{-5}$% by weight solution of a commercially available antistatic agent "Asa 3" of Shell in "Shell Sol T", i.e. a mixture of isoparaffins with 9-12 carbon atoms. "Asa 3" is a mixture of equal parts by weight of "Ca-Aerosol", i.e. the Ca-soap of the didecylester of sulphosuccinic acid, the Cr-soap of a mixture of alkylsalicylates ($C_{14}$ - $C_{18}$) and a copolymer of methacrylate and 2-methyl-5-vinylpyridine. The result of a method in which these intermediate rinsing operations are used in comparison with a method of manufacturing a display screen without these steps is distinguished by the absence of colour impurities.

The same effect is also obtained by intermediate rinsing operations with one of the following solutions:

a. a $3\times10^{-3}$% by weight solution of "Chrome AC", i.e. the chromium soap of a mixture of alkylsalicylates ($C_{14}$ to $C_{18}$) in "Shell Sol T", b. a $3\times10^{-3}$% by weight solution of "Ca-Aerosol OT", i.e. the Ca-soap of the dioctylester of sulphosuccinic acid in "Shell Sol T", c. a $3\times10^{-3}$% by weight solution of Ca-diisopropylsalicylate in "Shell Sol T", d. a $3\times10^{-3}$% by weight solution of cobalt naphthenate in "Shell Sol T".

The invention will be described in greater detail with reference to the following example and by means of the accompanying drawing which shows a part of a display screen of a colour televison display tube during the performance of the method according to the invention.

The FIGURE shows a face plate 1 of a colour televison display tube of the shadow mask type. An organic conductive layer 2 consisting of polyvinyl piperidinium chloride is provided on the face plate 1. An organic photoconductive layer 3 consisting of polyvinyl carbazol is provided on the conductive layer 2. A colour selection electrode 4 having apertures 5 is arranged immediately in front of the face plate 1 at exactly the same distance as it is located afterwards in the operating tube. A light source 6 of comparatively large dimensions throws light through the apertures 5. In practice, a correction lens for accurate matching of the place of the light source to the deflection point of the electron beam in the operating tube is arranged between the light source 6 and the shadow mask 4. The light spots 7 on the conductive layer 3 show a half-shadow 8. As a result of this, the light spots are considerably larger than the apertures 5. Prior to the exposure to light, the photoconductive layer 3 is provided with a negative surface charge. This is carried out by exposing the layer 3 to a corona discharge of an electrode which is at a high potential relative to the conductive layer 2. This is a known method which is also described in the U.S. Pat. No. 3,475,169. In the places illuminated by the light source the photoconductive layer 3 becomes conductive as a result of which the negative surface charge leaks away to the conductive layer 2. The light source 6 is first arranged in the deflection point of the electron beam which in the operating tube is to impinge upon the discrete regions with green phosphor. The light source is then arranged in the deflection point for blue. After this, only parts of the photoconductive layer which have not been exposed to light still contain negative electric charge. After removing the shadow mask 4, a suspension which comprises positively charged red luminescing phosphor particles in an insulating liquid is sprayed against the photoconductive layer. The said liquid consists of branched hydrocarbons, for example, a mixture of octane and nonane. Before the phosphor particles were suspended with the insulating liquid, they have been covered with a thin layer of a hygroscopic material for which, for example, a mixture of polyvinylalcohol, choline chloride and glycerin is very suitable. The red phosphor adheres to the oppositely charged unexposed places which form a pattern of dots having diameters smaller than the diameters of the apertures 5.

After drying the provided layer of red phosphor dots, the display screen is rinsed with one of the antistatic agents defined above.

The photoconductive layer 3 with the conductive phosphor dots is then again provided with a negative surface charge and exposed to light for providing the next pattern of phosphor dots. Since the red phosphor dots are conductive, the surface charge thereof can leak away via the exposed parts of the photoconductive layer 3. The next patterns of phosphor dots are provided in an entirely analogous manner with the same intermediate rinsing operation.

The display screen provided with all the patterns of phosphor dots, usually red, blue and green, is then heated in dry air as a result of which the water is expelled from the hygroscopic material around the phosphor grains. The photoconductive layer 3 is then provided with a positive surface charge. After uniform exposure of the photoconductive layer 3, said charge leaks away everywhere with the exception of the phosphor dots which are not non-conductive. The space between the phosphor dots is then filled with a light-absorbing material. For this purpose, a suspension is sprayed against the photoconductive layer 3 which consists of positively charged particles of a black pigmentation agent, for example graphite or a black metal oxide, in an insulating liquid. The light-absorbing material is repelled by the charge of the same sign of the phosphor dots and adheres to the remaining surface between the phosphor patterns.

The organic layers 2 and 3 are then removed by firing after which the phosphors and the light-absorbing substance immediately adhere to the glass of the display screen 1 without any mutual contamination.

What is claimed is:

1. In the method of electrophotographically manufacturing a display screen for a color television display tube wherein a combustible conducting coating is first applied to the face-plate of said tube, a combustible photo-conducting coating is applied to said combustible coating, a first pattern of phosphor zones is formed on said combustible photo-conducting coating by first uniformly electrically charging said photo-conducting coating, forming a latent charge pattern with the charged portions corresponding to the desired phosphor zones of said first pattern by exposing to light the zones on said electrically charged photoconducting coating between said desired phosphor zones, and then precipitating phosphor particles, having charges opposite to the charge on said unexposed portions of said electrically charged photo-conducting coating, from a suspension thereof in an apolar suspending medium, on said unexposed zones of said light electrically charged photo-conducting coating to thereby form the first pattern of phosphor zones, at least one subsequent pattern of phosphor zones is formed on said first pattern of phosphor zones by proceeding in a manner analogous to the formation of said first pattern of phosphor zones and said face-plate is then heated to remove by combustion said combustible conducting coating and said combustible photo-conducting coating, the improvement wherein after the formation of each phosphor pattern and before the formation of the subsequent charge pattern the resultant screen is wetted with a solution consisting essentially of an antistatic agent in an apolar solvent said antistatic agent being selected from the group consisting of soaps of bivalent metals, soaps of multivalent movalent metals and mixtures of said soaps, the conductivity of which soaps in said apolar solvent is between $5 \times 10^{-12}$ and $10^{-10}$ $ohm^{-1}$ $cm^{-1}$(500–10,000 p S/m) the electrical conductivity of which solvent is less than $10^{-4}$ $ohm^{-1}$ $cm^{-1}$ (1 p S/m) and dried.

2. The method of claim 1 wherein the conductivity of the metal soaps in the apolar solvent is between $10 \times 10^{-12}$ and $80 \times 10^{-12}$ $ohm^{-1}$ $cm^{-1}$ (1000 – 8000 s/m.

3. The method of claim 1 wherein a light-absorbing coating is provided between the phosphor particles by applying to the photo-conducting coating bearing the phosphor zones a suspension in an apolar liquid, of light absorbing particles having a charge of the same sign as the phosphor particles.

4. A colour television display tube whose display screen is obtained by a method as claimed in claim 1.

* * * * *

UNITED STATES PATENT AND TRADEMARK OFFICE

CERTIFICATE OF CORRECTION

PATENT NO. : 4,095,134

DATED : June 13, 1978

INVENTOR(S) : FRANCIS BERNARDUS STRIK

It is certified that error appears in the above-identified patent and that said Letters Patent are hereby corrected as shown below:

In the Claims:

Col. 4, line 50, delete "movalent"

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*